US005898025A

United States Patent [19]

Burg et al.

[11] Patent Number: 5,898,025

[45] **Date of Patent: *Apr. 27, 1999**

[54] MILDLY ALKALINE DISHWASHING DETERGENTS

[75] Inventors: Birgit Burg, Alpen; Juergen Haerer, Duesseldorf; Peter Jeschke, Neuss; Willi Buchmeier, Mettmann; Helmut Blum; Christian Nitsch, both of Duesseldorf; Heinz-Juergen Voelkel, Hilden; Horst-Dieter Speckmann, Langenfeld, all of Germany

[73] Assignee: Henkel Kommanditgesellschaft auf Aktien, Duesseldorf, Germany

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/904,747

[22] Filed: Aug. 1, 1997

Related U.S. Application Data

[63] Continuation of application No. 08/403,696, May 4, 1995, abandoned.

[30] Foreign Application Priority Data

Sep. 25, 1992 [DE] Germany ..... 42 32 170

[51] Int. Cl.[6] ..... C11D 3/10; C11D 3/37; C11D 17/00

[52] U.S. Cl. ..... 510/229; 510/220; 510/226; 510/375; 510/434; 510/435

[58] Field of Search ..... 510/220–230, 510/375, 435, 434

[56] References Cited

U.S. PATENT DOCUMENTS

| | | | |
|---|---|---|---|
| 3,816,318 | 6/1974 | Hentschel | 252/89 |
| 3,910,880 | 10/1975 | Lamberti | 260/210 R |
| 3,933,672 | 1/1976 | Bartolotta et al. | 252/116 |
| 4,162,287 | 7/1979 | Gomez et al. | 422/170 |
| 4,347,168 | 8/1982 | Murphy et al. | 252/547 |
| 4,753,748 | 6/1988 | Laitem et al. | 252/99 |
| 4,839,084 | 6/1989 | Ouhadi et al. | 252/174.21 |
| 4,889,652 | 12/1989 | Sullivan et al. | 252/99 |
| 4,923,636 | 5/1990 | Blackburn et al. | 252/550 |
| 5,030,377 | 7/1991 | Sone et al. | 252/174.12 |
| 5,078,907 | 1/1992 | Madison et al. | 252/186.39 |
| 5,094,771 | 3/1992 | Ahmed et al. | 252/99 |
| 5,292,446 | 3/1994 | Painter et al. | 252/99 |
| 5,559,089 | 9/1996 | Hartman et al. | 510/224 |
| 5,691,293 | 11/1997 | Kruse et al. | 510/224 |

FOREIGN PATENT DOCUMENTS

| | | |
|---|---|---|
| 135226 | 8/1983 | European Pat. Off. . |
| 135227 | 8/1983 | European Pat. Off. . |
| 0135227 | 3/1985 | European Pat. Off. . |
| 0135226 | 2/1990 | European Pat. Off. . |
| 0530635 | 8/1992 | European Pat. Off. . |
| 1544393 | 11/1967 | France . |
| 3321082 | 12/1983 | Germany . |
| 3937469 | 5/1991 | Germany . |
| 4137470 | 11/1991 | Germany . |
| 4102743 | 8/1992 | Germany . |
| 4228786 | 8/1992 | Germany . |
| 4110510 | 10/1992 | Germany . |
| 4112075 | 10/1992 | Germany . |
| 4205071 | 8/1993 | Germany . |
| 1-146998 | 6/1989 | Japan . |
| WO/00419 | 6/1991 | WIPO . |
| WO/9300419 | 1/1993 | WIPO . |

OTHER PUBLICATIONS

*Tenside Surfactants Detergents*, "Das Calciumbindevermögen", Richter and Windler, pp. 213–216. No English Translation.

*Primary Examiner*—Margaret Einsmann
*Attorney, Agent, or Firm*—Ernest G. Szoke; Wayne C. Jaeschke; Real J. Grandmaison

[57] ABSTRACT

A phosphate-free mildly alkaline, dishwashing detergent composition containing:

(a) from 20 to 60% by weight of sodium citrate;

(b) from 5 to 50% by weight of alkali metal hydrogen carbonate;

(c) from 7 to 12% by weight of alkali metal carbonate;

(d) from 2 to 20% by weight of a bleaching agent;

(e) from 1 to 8% by weight of a bleaching agent activator; and (f) from 0.2 to 4% by weight of an enzyme, all weights being based on the weight of the composition wherein the composition in the form of a 1% by weight aqueous solution has a pH value of from about 8 to less than 10.

15 Claims, No Drawings

MILDLY ALKALINE DISHWASHING DETERGENTS

This application is a continuation of application Ser. No. 08/403,696, filed on May 4, 1995, now abandoned.

Mildly alkaline detergents for dishwashing machines are known per se. They essentially contain peroxy compounds as bleaching agents, enzymes as detergency boosters, penta-alkali metal triphosphates and alkali metal silicates as builders, nonionic surfactants and alkali metal carbonates as buffer. Their pH value in use is below 11, but may even be 7 (cf. FR 1 544 393, U.S. Pat. No. 4,162,289, EP 135 226, EP 135 227). Accordingly, compounds showing a basically alkaline reaction have hitherto been used as one of the starting materials and the pH value of—up to then—usually above 11 has been correspondingly reduced by suitable combinations and additives.

It has now been found that highly effective detergents for dishwashing machines can also be obtained by approaching the solution to the problem from the side of a neutral pH value. In this way, penta-alkali metal triphosphate can be completely replaced and the content of hitherto typical phosphate substitutes, such as native and synthetic polymers (cf. DE 41 02 743, DE 41 12 075, DE 41 10 510, DE 41 37 470, DE 42 05 071), can also be greatly reduced or completely eliminated.

DESCRIPTION OF THE INVENTION

The present invention relates to a mildly alkaline detergent for dishwashing machines which is characterized in that it contains sodium citrate, sodium hydrogen carbonate, a bleaching agent, a bleach activator and enzymes as essential components and, in the form of a 1% by weight aqueous solution, has a pH value of about 8 to <10 and preferably of about 9 to 9.5.

Anhydrous trisodium citrate or, preferably, trisodium citrate dihydrate may be used as the sodium citrate. Trisodium citrate dihydrate may be used in the form of a finely or coarsely crystalline powder.

The content of trisodium citrate dihydrate is around 20 to 60% by weight and preferably of the order of 30 to 50% by weight. All or part of the trisodium citrate dihydrate, i.e. around 80% by weight and preferably around 50% by weight, may be replaced by naturally occurring hydroxycarboxylic acids such as, for example, monohydroxysuccinic acid, dihydroxysuccinic acid, α-hydroxypropionic acid and glucose acid.

The alkali metal hydrogen carbonate is preferably sodium bicarbonate. The sodium bicarbonate should preferably be used in a coarse compacted form with a particle size in the main fraction of around 0.4 to 1.0 mm. Its percentage content in the detergent is of the order of 5 to 50% by weight and preferably of the order of 25 to 40% by weight.

As bleaching agents, active oxygen carriers have for some time been preferred constituents of detergents for domestic dishwashing machines (DDWM). They include above all sodium perborate monohydrate and tetrahydrate and sodium percarbonate. Compacted sodium perborate monohydrate is preferred by virtue of the increase in apparent density. However, the use of sodium percarbonate stabilized, for example, with boron compounds (DE-OS 33 21 082) also has advantages insofar as this compound has a particularly favorable effect on the corrosion behavior of glasses. Since active oxygen only becomes fully active on its own at elevated temperatures, so-called bleaching activators are used for activation at around 60° C., the approximate temperature of the washing process in DDWM. Preferred bleach activators are TAED (tetraacetyl ethylenediamine), PAG (pentaacetyl glucose), DADHT (1,5-diacetyl-2,2-dioxohexahydro-1,3,5-triazine) and ISA (isatoic anhydride). In addition, it can be useful to add small quantities of known bleach stabilizers such as, for example, phosphonates, borates or metaborates and metasilicates. The percentage content of bleaching agent in the detergent as a whole is of the order of 2 to 20% by weight and preferably of the order of 5 to 10% by weight while the percentage content of bleaching activator is around 1 to 8% by weight and preferably around 2 to 6% by weight.

To improve the removal of protein- and starch-containing food residues, it is possible to use enzymes, such as proteases, amylases, lipases and cellulases, for example proteases, such as BLAP® 140, a product of Henkel; Optimase®-M-440, Optimase®-M-330, Opticlean®-M-375, Opticlean®-M-250, products of Solvay Enzymes; Maxacal® CX 450.000, Maxapem®, products of Ibis, Savinase® 4,0 T 6,0 T 8,0 T, products of Novo, or Experase® T, a product of Ibis, and amylases, such as Termamyl® 60 T, 90 T, products of Novo; Amylase-LT®, a product of Solvay Enzymes, or Maxamyl® P 5000, CXT 5000 or CXT 2900, products of Ibis, lipases, such as Lipolase® 30 T, a product of Novo, cellulases, such as Celluzym® 0,7 T, a product of Novo Nordisk. The enzymes may each be present in the detergent in quantities of around 0.2 to 4% by weight and preferably in quantities of around 0.5 to 1.5% by weight, based on the detergent as a whole.

Alkali metal carbonates may also be added as alkali carriers to the detergents according to the invention. However, if the detergents are to remain free from special labelling, it is important to keep to the EEC preparation guidelines for detergents. The alkali metal carbonate may be used in a quantity of around 0 to around 20% by weight and is preferably used in a quantity of around 7 to 12% by weight. If naturally occurring $Na_2CO_3.NaHCO_3$ (Trona, a product of Solvay) is used, the quantity used may have to be doubled. To protect the articles to be washed (more particularly aluminium, glazed-on decorations and glasses) against corrosion, sodium disilicate ($Na_2O:SiO_2$=1:2) may usefully be added. The quantities need only be small, amounting to between 0 and about 10% by weight and preferably to between 0 and about 4% by weight.

If distinctly higher contents of soda or disilicate, for example 10 or 5% by weight, are used, the pH value of a 1% detergent formulation increases beyond the required mildly alkaline range of around 9.0 to 9.5. In this case, sodium hydrogen carbonate may be replaced by citric acid in quantities of 0 to around 15% by weight and preferably in quantities of around 0 to 8% by weight.

Although there is no need to add native or synthetic polymers, they may be added to detergents intended for use in hard-water areas in quantities of at most about 12% by weight and preferably in quantities of around 3 to 8% by weight. The native polymers include, for example, oxidized starch (for example German patent application P 42 28 786.3) and polyamino acids, such as polyglutamic acid or polyaspartic acid (for example the products of Cygnus and SRCHEM).

The synthetic polymer used is preferably the successful powder-form poly(meth)acrylate with an active substance content of around 92 to 95% by weight and/or a granular alkaline detergent additive based on sodium salts of homopolymeric or copolymeric (meth)acrylic acids which is the subject of DE-OS 39 37 469. This additive consists of:

(a) 35 to 60% by weight of sodium salts of at least one homopolymeric or copolymeric (meth)acrylic acid, (b) 25 to 50% by weight of sodium carbonate (anhydrous), (c) 4 to 20% by weight of sodium sulfate (anhydrous) and (d) 1 to 7% by weight of water and preferably of (a) 40 to 55% by weight and, more particularly, 45 to 52% by weight, (b) 30 to 45% by weight and, more particularly, 30 to 40% by weight, (c) 5 to 15% by weight and, more particularly, 5 to 10% by weight and (d) 2 to 6% by weight and, more particularly, 3 to 5% by weight of the compounds mentioned above.

The poly(meth)acrylates may be used in powder form or in the form of a 40% aqueous solution, but preferably in granular form. Suitable polyacrylates include Alcosperse® types, products of Alco: Alcosperse® 102, 104, 106, 404, 406; Acrylsol® types, products of Norsohaas: Acrylsol® A 1N, LMW 45N, LMW 10N, LMW 20N, SP 02N, Norasol® SL1, WL2, WL3, WL4; Degapas®, a product of Degussa; Goodrite® K-XP 18, a product of Goodrich. Copolymers of polyacrylic acid and maleic acid (poly(meth)acrylates) may also be used and include, for example, Sokalan® types, products of BASF: Sokalan® CP 5, CP 7; Acrysol® types, products of Norsohaas: Acrysol® QR 1014; Alcosperse® of Alco: Alcosperse® 175; the granular alkaline detergent additive according to DE 39 37 469.

Up to about 5.0% by weight and, more particularly, around 0.01 to 0.3% by weight of nitrogen-containing corrosion inhibitors are preferably added to the detergents according to the invention to prevent tarnishing, above all of silver dishes and cutlery. These nitrogen-containing compounds may be amino acids, such as histidine or cysteine, or heterocycles containing 2 or 3N atoms in the ring. Effective compounds containing 2N atoms in the ring include, for example, 4-methyl-2-pyrazolin-5-one and 3-methyl-3-pyrazolin-5-one. Representatives of compounds containing 3N atoms in the ring are, for example, benzotriazole, tolyl triazole and N-alkylated tolyl triazole (Belclene® 512). However, isocyanuric acid and melamine have also proved to be effective. These compounds may be used either individually or in the form of mixtures.

Nonionic surfactants may also be added to the detergents according to the invention to improve the removal of fat-containing food remains and to act as wetting agents and as granulation aids. They may be added in quantities of 0 to around 4% by weight and preferably in quantities of 1 to 2% by weight. Extremely low-foaming compounds are normally used, $C_{12-18}$ alkyl polyethylene glycol/polypropylene glycol ethers containing up to 8 moles of ethylene oxide and 8 moles of propylene oxide units in the molecule being preferred. However, it is also possible to use nonionic surfactants other than known low-foaming types, such as for example $C_{12-18}$ alkyl polyethylene glycol/polybutylene glycol ethers containing up to 8 moles of ethylene oxide and 8 moles of butylene oxide units in the molecule, end-capped alkyl polyalkylene glycol mixed ethers and the foaming, but ecologically attractive $C_{8-10}$ alkyl polyglucosides and/or $C_{12-14}$ alkyl polyethylene glycols containing 3 to 8 ethylene oxide units in the molecule for a degree of polymerization of around 1 to 4, which are used together with 0 to about 1% by weight and preferably 0 to about 0.5% by weight, based on the detergent as a whole, of foam inhibitors, such as for example silicone oils, mixtures of silicone oil and hydrophobicized silica, paraffin oil/Guerbet alcohols, bis-stearyl acid diamide, hydrophobicized silica and other known commercially available foam inhibitors. $C_{8-10}$ alkyl polyglucoside with a degree of polymerization of around 1 to 4 may be used. A bleached type should be used because otherwise the granules obtained will be brown in color.

Finally, other typical detergent components, such as dyes and fragrances for example, may be added to the detergents according to the invention.

To produce the detergents according to the invention, the sodium salts of homopolymeric or copolymeric (meth) acrylic acids (as polymer) may optionally be introduced with sodium carbonate and sodium bicarbonate into a mixer, for example a plowshare mixer, and subsequently subjected to agglomerating granulation in the presence of liquids, such as water, a nonionic surfactant or liquid poly(meth)acrylate, the resulting granules optionally adjusted to a uniform size distribution in a second granulation stage and then dried with agitation in a stream of warm air, after which fine and coarse particles are removed and the granules are subsequently mixed with a bleaching agent and, optionally, a bleach activator, a bleach stabilizer, fragrance, enzymes, nonionic surfactants, trisodium citrate dihydrate and/or dyes.

The trisodium citrate dihydrate may even be added in the first granulation stage.

Since the alkali metal carbonate content has a considerable bearing on the alkalinity of the product, drying has to be carried out in such a way that the bicarbonate decomposition of the sodium bicarbonate to sodium carbonate is minimal (or at least constant). This is because any sodium carbonate additionally formed by drying would have to be taken into account in the formulation of the granules. Low drying temperatures not only counteract the decomposition of sodium bicarbonate, they also increase the solubility of the granular detergent in use. Accordingly, the drying process is advantageously carried out at a temperature of the inflowing air which, on the one hand, should be as low as possible to avoid bicarbonate decomposition but which, on the other hand, should be as high as necessary to obtain a product with good storage properties. Drying is preferably carried out at a temperature of the inflowing air of around 80° C. The granules themselves should not be heated to temperatures above about 60° C. In contrast to the production process, the decomposition of the sodium bicarbonate is entirely desirable in the subsequent use of the detergent in the dishwashing machine because the alkalinity of the liquor and hence its cleaning performance are increased in this way. The in situ formation of sodium carbonate (which irritates the eyes and the skin) from sodium hydrogen carbonate (non-irritating) reduces dangers for the consumer, for example in the event of improper use by children.

The following ranges, for example, are suitable for starting formulations of virtually all possible constituents of the granular detergents produced in accordance with the invention, representing the active substance content in % by weight and always adding up to 100% by weight:

20 to 60 and preferably around 30 to 50% by weight of citrate or salts of hydroxycarboxylic acids, 0 to 15 and preferably around 0 to 8% by weight of citric acid, 0 to 12 and preferably around 3 to 8% by weight of polymer (native or synthetic), 0 to 20 and preferably around 7 to 12% by weight of soda or 0 to 40 and preferably 14 to 24% by weight of Trona,
0 to 10 and preferably around 0 to 4% by weight of sodium silicate,
5 to 50 and preferably around 25 to 40% by weight of sodium hydrogen carbonate,
0 to 15 and preferably around 5 to 10% by weight of sodium perborate,
0 to 20 and preferably around 5 to 10% by weight of sodium percarbonate, either perborate or percarbonate having to be present,
1 to 8 and preferably around 2 to 6% by weight of TAED,
0 to 5 and preferably around 0.01 to 0.3% by weight of corrosion inhibitors,
0 to 4 and preferably around 1 to 2% by weight of nonionic surfactant,
<4 and preferably around 0.5 to 1.5% by weight of amylase,
<4 and preferably around 0.5 to 1.5% by weight of protease,
<4 and preferably around 0.5 to 1.5% by weight of lipase,
<4 and preferably around 0.5 to 1.5% by weight of cellulose.

EXAMPLES

The favorable properties of the mildly alkaline detergents according to the invention in preventing bloom were tested in comparison with known detergents containing pentasodium triphosphate.

The increased calcium binding capacity of citrate at pH values of 7 to 10 was demonstrated by the Hampshire test (Tenside, Surf. Deterg. 24 (1987), 213–216) as a function of temperature and pH value. It was surprising to find that the calcium binding capacity of pentasodium triphosphate under these low-alkali conditions is significantly lower than that of the citrate at the same pH value. Accordingly, the advantage of pentasodium triphosphate lies above all at relatively high pH values (>pH 10 for 1% solutions), as prevail in conventional detergents.

1. Calcium binding capacity of trisodium citrate dihydrate (expressed in mg of calcium carbonate per g of citric acid) and of pentasodium triphosphate (expressed in mg of calcium carbonate per g of triphosphoric acid) as a function of the washing temperature at pH values of 10, 9.5 and 9.0.

Table 1 shows that the calcium binding capacity of citrate is distinctly dependent both on temperature and on pH. At the operating temperatures of 50° C. to 65° C. and pH values of 9 to 10, the calcium binding capacity improves with decreasing pH and with decreasing temperature. By contrast, pentasodium triphosphate shows hardly any dependence on pH (Table 2). For the comparison with pentasodium triphosphate, this means that, at pH 9.5/50° C. for example, the calcium binding capacity of citrate is distinctly higher.

TABLE 1

Calcium complexing capacity of sodium citrate

| | Temperature [° C.] | | | | |
|---|---|---|---|---|---|
| pH value | 50 | 55 | 60 | 65 | 70 |
| 9.0 | 480 | 470 | 390 | 370 | 310 |
| 9.5 | 370 | 250 | 250 | 240 | 180 |
| 10.0 | 240 | 180 | 180 | 170 | 150 |

Calcium binding capacity in mg of $CaCO_3$/g of complexing agent (acid form)

TABLE 2

Calcium complexing capacity of pentasodium triphosphate

| | Temperature [° C.] | | | | |
|---|---|---|---|---|---|
| pH value | 50 | 55 | 60 | 65 | 70 |
| 9.0 | 310 | 290 | 260 | 260 | 230 |
| 9.5 | 320 | 290 | 270 | 260 | 230 |
| 10.0 | 320 | 300 | 280 | 230 | 230 |

Calcium binding capacity in mg of $CaCO_3$/g of complexing agent (acid form)

2. Comparison of bloom formation under hard water conditions in the dishwashing machine The detergents according to Example 4 were tested for bloom formation after 10 wash cycles in a Miele G 590 dishwashing machine (6.2 l of water with a hardness of 16° dH, operating temperature 65° C.) with addition of 50 g of a pumpable soil. The detergents were used in the quantities shown. On a scale of 1 (=no bloom) to 10 (=very heavy bloom), detergents 2 to 6 according to the invention achieved the scores shown in Table 5 below for bloom formation in the machine (value A) and bloom formation on the machine load (china/glass/cutlery; value B). Comparison of the low-alkali formulations (2 to 6, pH value approx. 9.5) with the high-alkali phosphate-containing formulation C showed that the bloom-inhibiting effect of the detergents according to the invention was as good as or far better than that of the conventional detergent.

TABLE 4

Compositions of the detergent formulations tested in % by weight

| Formulation | Soda | $NaHCO_3$ | TNC*.$2H_2O$ | Polyacrylate (Sokalan CP5) | Others: perborate, TAED, nonionic surfactant, enzymes, perfume oil, $Na_2SO_4$, $H_2O$ |
|---|---|---|---|---|---|
| 1 | 13% | 39% | 20% | 10% | 18% |
| 2 | 10% | 34% | 30% | 10% | 16% |
| 3 | 10% | 14% | 50% | 10% | 16% |
| 4 | 10% | 20% | 50% | 4% | 16% |
| 5 | 10% | 24% | 50% | — | 16% |
| 6 | 10% | 34% | 40% | — | 16% |

C Phosphate- and metasilicate-containing detergent with 28% tripolyphosphate
*TNC = Trisodium citrate

TABLE 5

Scoring of bloom formation in the dishwashing machine under hard water conditions

| Formulation | Quantity used [g] | Bloom A | Bloom B |
|---|---|---|---|
| 1 | 15 | 8 | 9.5 |
| 2 | 20 | 3 | 6.5 |
| 3 | 20 | 3.5 | 6.0 |
| 4 | 20 | 3.0 | 2.0 |
| 5 | 20 | 1.5 | 2.0 |
| 6 | 20 | 3.0 | 2.0 |
| 1 | 30 | 3.0 | 6.0 |
| 2 | 30 | 1.5 | 2.5 |
| C | 30 | 6.5 | 6.0 |

3. Table 3 compares the calcium binding capacity of a few natural carboxylic acids, as determined by the Hampshire test. The citric acid containing three functional carboxyl groups has the highest calcium binding capacity. pH dependence is similar for all carboxylic acids, the highest binding capacity being observed with decreasing pH. Similarly, the calcium binding capacity increases analogously with the number of carboxyl groups. The letters appearing in the Table have the following meanings:

Hydroxymonocarboxylic acids:

A=lactobionic acid potassium salt (Solvay)

B=L-ascorbic acid sodium salt (Fluka)

C=D-gluconic acid sodium salt (Magazin, Henkel)

Hydroxydicarboxylic acids:

D=D-glucaric acid potassium salt (Aldrich)

E=tartaric acid disodium salt dihydrate (Merck)

Hydroxytricarboxylic acid:

F=trisodium citrate dihydrate (Magazin, Henkel)

Dicarboxylic acid mixture, HOOC—$(CH_2)_n$OCOOH, n=2,3,4:

G=SOKALAN® DCS (BASF)

Note:In the case of tartaric acid and citrate, the weighed sample was based on the empirical formula without water of crystallization!

TABLE 3

Comparison of the calcium complexing capacity of various naturally occurring carboxylic acids at 20° C. and, for example F', at 50° C.

| | Natural carboxylic acids/types | | | | | | | |
|---|---|---|---|---|---|---|---|---|
| pH value | A | B | C | D | E | F | G | F' |
| 9.0 | 203 | 168 | 196 | 589 | 687 | 937 | 223 | 480 |
| 9.5 | 127 | 118 | 121 | 323 | 343 | 625 | 132 | 370 |
| 10.0 | 100 | 9 | 95 | 155 | 143 | 478 | 100 | 240 |

Calcium binding capacity in mg of $CaCO_3$/g of complexing agent (acid form)

We claim:

1. A phosphate-tree, mildly alkaline, dishwashing machine detergent composition consisting essentially of (a) from 30 to 50% by weight of sodium citrate;

(b) from 25 to 40% by weight of alkali metal bicarbonate;

(c) from 2 to 20% by weight of a bleaching agent;

(d) from 1 to 8% by weight of a bleaching agent activator; and (e) from 0.2 to 4% by weight of an enzyme;

all weights being based on the weight of said composition, and wherein said composition in the form of a 1% by weight aqueous solution has a pH value of from about 8 to less than 10.

2. The composition of claim 1 wherein said sodium citrate is selected from the group consisting of anhydrous trisodium citrate, trisodium citrate dihydrate, and mixtures thereof.

3. The composition of claim 1 wherein said alkali metal bicarbonate is sodium bicarbonate.

4. The composition of claim 1 wherein said bleaching agent is selected from the group consisting of sodium perborate monohydrate, sodium perborate tetrahydrate.

5. The composition of claim 1 wherein said bleaching agent activator is selected from the group consisting of tetraacetyl ethylenediamine, 1,5-diacetyl-2,2-dioxohexahydro-1,3,5-triazine, and mixtures thereof.

6. The composition of claim 1 further containing a component selected from the following of an alkali metal disilicate, free citric acid, corrosion inhibitors, nonionic surfactants, and mixtures thereof.

7. The composition of claim 6 wherein said corrosion inhibitors comprise nitrogen-containing compounds selected from the group consisting of amino acids, heterocycles with 2 nitrogen atoms, heterocycles with 3 nitrogen atoms, and mixtures thereof.

8. The composition of claim 1 wherein said enzyme is selected from the group consisting of amylase, protease, lipase and cellulase.

9. The composition of claim 1 further containing up to 4% by weight of a nonionic surfactant.

10. A process for washing dishware comprising contacting said dishware with a phosphate-free, mildly alkaline, dishwashing machine detergent composition in the form of an aqueous solution, said detergent composition consisting essentially of:

(a) from 30 to 50% by weight sodium citrate;

(b) from 25 to 40% by weight of alkali metal bicarbonate;

(c) from 2 to 20% by weight of a bleaching agent:

(d) from 1 to 8% by weight of a bleaching agent activator; and (t) from 0.2 to 4% by weight of an enzyme;

all weights begin based on the weight of said composition, and said composition in the form of a 1% by weight aqueous solution has a pH value of from about 8 to less than 10.

11. The process of claim 10 wherein said sodium citrate is selected from the group consisting of anhydrous trisodium citrate, trisodium citrate dihydrate, and mixtures thereof.

12. The process of claim 10 wherein said alkali metal bicarbonate is sodium bicarbonate.

13. The process of claim 10 wherein said bleaching agent is selected from the group consisting of sodium perborate monohydrate, sodium perborate tetrahydrate, sodium percarbonate, and mixtures thereof.

14. The process of claim 10 wherein said bleaching agent activator is selected from the group consisting of tetraacetyl ethylenediamine, 1,5-diacetyl-2,2-dioxohexahydro-1,3,5-triazine, and mixtures thereof.

15. The process of claim 10 wherein said composition further contains a component selected from the following of an alkali metal disilicate, free citric acid, corrosion inhibitors, nonionic surfactants, and mixtures thereof.

* * * * *